US007748954B2

(12) United States Patent
Eguchi et al.

(10) Patent No.: US 7,748,954 B2
(45) Date of Patent: Jul. 6, 2010

(54) CENTRIFUGAL FAN

(75) Inventors: Tsuyoshi Eguchi, Takasago (JP); Atsushi Suzuki, Kiyosu (JP); Tetsuo Tominaga, Takasago (JP); Mitsuhiro Nakao, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 701 days.

(21) Appl. No.: 11/702,163

(22) Filed: Feb. 5, 2007

(65) Prior Publication Data

US 2008/0095629 A1 Apr. 24, 2008

(30) Foreign Application Priority Data

Oct. 19, 2006 (JP) ..... 2006-284656

(51) Int. Cl.
*F01D 5/22* (2006.01)

(52) U.S. Cl. ..... 415/119; 415/173.6; 415/204; 415/206; 415/208.1; 415/223; 416/183; 416/185; 416/186 R; 416/189; 416/192

(58) Field of Classification Search ..... 415/119, 415/173.6, 204, 206, 208.1, 223; 416/183, 416/185, 186 R, 189, 192
See application file for complete search history.

(56) References Cited

U.S. PATENT DOCUMENTS

| | | | | |
|---|---|---|---|---|
| 5,215,437 | A * | 6/1993 | TeVelde et al. | 415/223 |
| 5,352,089 | A * | 10/1994 | Tokunaga et al. | 415/206 |
| 6,299,409 | B1 * | 10/2001 | Matsunaga et al. | 415/206 |
| 2005/0226721 | A1 | 10/2005 | Higashida | |

FOREIGN PATENT DOCUMENTS

| | | |
|---|---|---|
| CN | 1548775 | 11/2004 |
| JP | 3351438 | 1/1995 |
| JP | 3438269 | 5/1995 |

* cited by examiner

*Primary Examiner*—Igor Kershteyn
(74) *Attorney, Agent, or Firm*—Wenderoth, Lind & Ponack, L.L.P.

(57) ABSTRACT

A centrifugal fan includes a space in which the dimension between a shroud-facing wall and a shroud, from the outer peripheral side to the inner peripheral side of the shroud, is substantially uniform, wherein the shroud-facing wall includes a recess extending in the circumferential direction, the recess being disposed at the inner peripheral side of the outer peripheral end of the shroud-facing wall forming the space having the uniform dimension so that the recess forms a space larger than the other part.

6 Claims, 6 Drawing Sheets

CENTRIFUGAL FAN

BACKGROUND OF THE INVENTION

1. Field of the Invention

The present invention relates to a centrifugal fan that is suitable for use as, for example, a fan of an air-conditioning system for vehicles.

2. Description of Related Art

Heating, ventilation, and air-conditioning (HVAC) units are widely used in air-conditioning systems for vehicles. A fan included in such an HVAC unit is, for example, a centrifugal fan. When a centrifugal fan including an impeller with a shroud is used as the centrifugal fan, a space is unavoidably provided between the shroud and a casing wall facing the shroud. A pressure difference is generated in this space by a pressurized main flow at the outlet side of the impeller, resulting in the generation of a leakage flow that flows against the main flow. This leakage flow causes not only a decrease in the efficiency of the fan but also noise when the leakage flow is combined with the main flow again.

According to Publication of Japanese Patent No. 3351438, in order to suppress such a leakage flow, the above space is formed so as to have a uniform dimension from the outer peripheral side to the inner peripheral side of the shroud.

BRIEF SUMMARY OF THE INVENTION

However, as described in Publication of Japanese Patent No. 3351438, even when the space is formed so as to have a uniform dimension, the leakage flow still exists. Accordingly, a technique for further suppressing the leakage flow has been desired.

The present invention has been made in view of the above situation, and it is an object of the present invention to provide a centrifugal fan in which a leakage flow that flows backward in a space disposed between a shroud and a wall facing the shroud can be minimized.

In order to solve the above problem, a centrifugal fan of the present invention provides the following solutions.

Namely, a centrifugal fan of the present invention includes an impeller that is rotated around an axis; a casing that accommodates the impeller, that includes a bellmouth forming a substantially circular gas intake whose axis is the same as the axis around which the impeller rotates, and that forms a spiral flow path at the outer peripheral side of the impeller; and a driving unit that rotates the impeller, wherein the impeller includes a bottom plate that is rotated by the driving unit around the axis, a plurality of vanes that are disposed on the outer periphery of the bottom plate, and a substantially annular shroud that is concentrically disposed so as to face the bottom plate, with the vanes disposed therebetween, and that connects an end of each of the vanes, the shroud has a shape that is slanted with respect to the axis so as to approach the bottom plate from the inner peripheral side toward the outer peripheral side, the casing includes a shroud-facing wall that forms a space in which the dimension between the shroud and the shroud-facing wall, from the outer peripheral side to the inner peripheral side of the shroud, is substantially uniform, and the shroud-facing wall includes a recess extending in the circumferential direction, the recess being disposed at the inner peripheral side of the outer peripheral end of the shroud-facing wall that forms the space having the uniform dimension so that the recess forms a space larger than the other part of the space having the uniform dimension.

When the impeller is rotated by the driving unit, a gas (e.g. air) is introduced from the bellmouth forming the gas intake by the action of the vanes provided in the impeller. The introduced gas flows out to the spiral flow path through the vanes disposed between the bottom plate and the shroud. The shroud has a shape that is slanted so as to approach the bottom plate from the inner peripheral side toward the outer peripheral side. Thus, a centrifugal impeller is formed. When a main flow flows from the bellmouth to the spiral flow path through the vanes, the pressure at the downstream side (the outlet of the impeller) is increased by this main flow. Accordingly, a pressure difference is generated in the space disposed between the shroud and the shroud-facing wall, and a leakage flow that flows backward, i.e., from the outer peripheral side to the inner peripheral side, is generated.

In the present invention, a recess that forms a space larger than the other part is provided at the inner peripheral side of the outer peripheral end of the shroud-facing wall so as to extend in the circumferential direction. Accordingly, the leakage flow is rapidly contracted in the space provided between the outer peripheral end of the shroud-facing wall and the shroud and is then rapidly expanded in the recess. When the leakage flow is subjected to such a rapid contraction and a rapid expansion in this way, a loss occurs in the leakage flow, and thus the flow rate of the leakage flow can be minimized.

In the centrifugal fan of the present invention, a protrusion protruding toward the shroud side may be provided at the inner peripheral side of the recess.

Since the protrusion protruding toward the shroud side is provided at the inner peripheral side of the recess, the leakage flow that is rapidly expanded in the recess can be hindered. Since a resistance can be further provided to the leakage flow in this way, not only can the flow rate of the leakage flow be reduced, but also the flow rate distribution in the circumferential direction (the rotation direction) can be made uniform, thereby suppressing the generation of noise caused by flow fluctuations.

A centrifugal fan of the present invention includes an impeller that is rotated around an axis; a casing that accommodates the impeller, that includes a bellmouth forming a substantially circular gas intake whose axis is the same as the axis around which the impeller rotates, and that forms a spiral flow path at the outer peripheral side of the impeller; and a driving unit that rotates the impeller, wherein the impeller includes a bottom plate that is rotated by the driving unit around the axis, a plurality of vanes that are disposed on the outer periphery of the bottom plate, and a substantially annular shroud that is concentrically disposed so as to face the bottom plate, with the vanes disposed therebetween, and that connects an end of each of the vanes, the shroud has a shape that is slanted with respect to the axis so as to approach the bottom plate from the inner peripheral side toward the outer peripheral side, the casing includes a shroud-facing wall that forms a space in which the dimension between the shroud and the shroud-facing wall, from the outer peripheral side to the inner peripheral side of the shroud, is substantially uniform, and the shroud-facing wall includes a groove extending in the substantially radial direction, the recess being disposed from the outer peripheral end to the inner peripheral side of the shroud-facing wall.

By forming the groove extending in the substantially radial direction on the shroud-facing wall, when viewed from the shroud, the space provided between the shroud and the shroud-facing wall continuously changes in accordance with the rotation of the impeller. Accordingly, a resistance to the leakage flow can be provided, thereby blocking the leakage flow.

The groove of the present invention need not be provided around the entire circumference of the shroud-facing wall.

For example, the groove is preferably provided in the vicinity of a tongue where the leakage flow is significant.

In the centrifugal fan of the present invention, the groove may include an outer peripheral portion slanted in a direction opposite to the rotational direction of the impeller and an inflection portion that is connected to the outer peripheral portion to change the direction of a flow path.

The leakage flow flows in the space while having a velocity component in the rotation direction of the impeller. Consequently, the leakage flow is taken by the outer peripheral portion slanted in the direction opposite to the rotational direction of the impeller and is then bent by the inflection portion connected to the outer peripheral portion, thereby increasing the pressure. Accordingly, the leakage flow can be hindered.

A centrifugal fan of the present invention includes an impeller that is rotated around an axis, a casing that accommodates the impeller and that includes a bellmouth forming a substantially circular gas intake whose axis is the same as the axis around which the impeller rotates, and a driving unit that rotates the impeller, wherein a curved surface is provided on the inner peripheral edge of the downstream side of the bellmouth.

Since the curved surface is provided on the inner peripheral edge of the downstream side of the bellmouth, the gas flow introduced from the gas intake is not disturbed. The curved surface is preferably formed by forming an R-shaped chamfer having a circular-arc-shaped cross section.

This aspect of the present invention can be combined with the above-described other aspects of the present invention.

According to the present invention, the following advantages can be achieved.

A recess that forms a space larger than the other part is provided at the inner peripheral side of the outer peripheral end of the shroud-facing wall so as to extend in the circumferential direction. Accordingly, abrupt expansion and a abrupt contraction of the leakage flow can be induced, causing a loss, and thus, the flow rate of the leakage flow can be minimized.

In addition, since a protrusion protruding toward the shroud side is provided at the inner peripheral side of the recess, the leakage flow that is abruptly expanded in the recess can be hindered. Accordingly, not only can the flow rate of the leakage flow be reduced, but also the flow rate distribution in the circumferential direction (the rotation direction) can be made uniform, thereby suppressing the generation of noise caused by flow fluctuations.

Furthermore, by forming a groove extending in the substantially radial direction on the shroud-facing wall, the space formed between the shroud-facing wall and the shroud can continuously change in accordance with the rotation of the impeller. Accordingly, a resistance to the leakage flow can be provided, thereby hindering the leakage flow.

DETAILED DESCRIPTION OF THE INVENTION

Embodiments of the present invention will now be described with reference to the drawings.

First Embodiment

A first embodiment of the present invention will now be described with reference to FIGS. 1 to 3.

Figure 1:
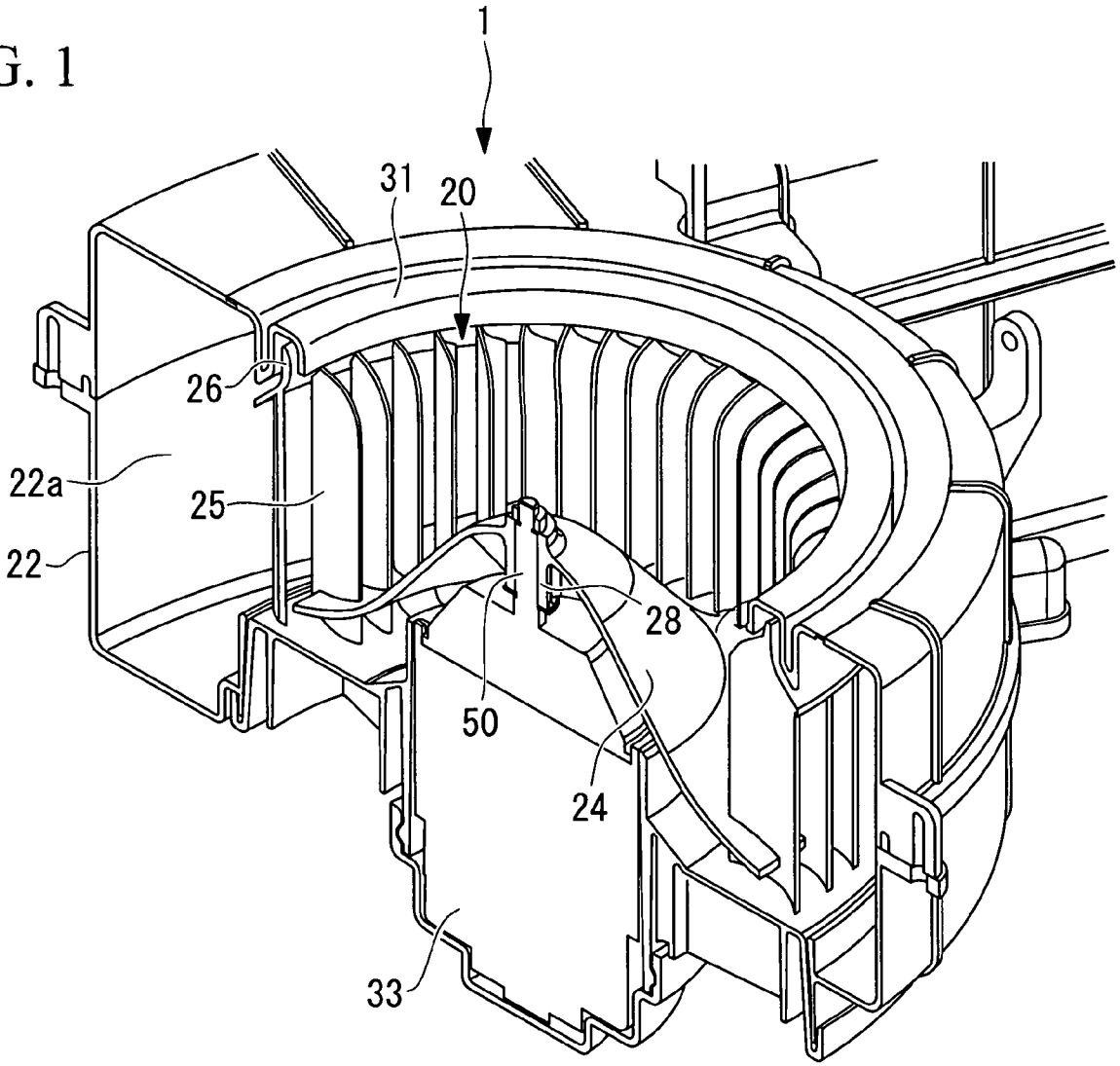
FIG. 1 is a partial cross-sectional perspective view showing a centrifugal fan according to an embodiment of the present invention.

FIG. 1 shows a centrifugal fan used in an HVAC unit, which is an air-conditioning system for vehicles.

The centrifugal fan 1 includes a driving motor (driving unit) 33, a casing 22, and a centrifugal impeller 20.

The driving motor 33 is an electric motor, and electrical power is supplied from a power supply (not shown) to the driving motor 33. A rotary shaft 50 of the driving motor 33 extends in the upper direction in the figure and is connected to a boss 28 of the impeller 20.

A bellmouth 31 forming a circular air intake is provided near the center of the upper part of the casing 22. A scroll flow path (spiral flow path) 22*a* is provided at the side of the outer periphery of the casing 22, i.e., at the outlet side of the impeller 20 (see, for example, FIG. 7 in addition to FIG. 1).

The impeller 20 includes a bottom plate 24, a plurality of main blades (vanes) 25, and a shroud 26.

The bottom plate 24 has a cone shape in which the central part thereof protrudes so as to enclose the side of the rotary shaft 50 of the driving motor 33. The boss 28, to which a driving force from the driving motor 33 is transmitted, is provided at the central position of the bottom plate 24.

Each of the main blades 25 is fixed in a state in which one end thereof (the lower end in FIG. 1) is inserted in the outer peripheral part of the bottom plate 24. The main blades 25 are disposed so that the longitudinal direction thereof is directed in a direction parallel to the rotational axis of the driving motor 33. The plurality of main blades 25 are provided at predetermined intervals in the circumferential direction.

The shroud 26 is connected to the other end (the upper end in FIG. 1) of the main blades 25.

Figure 2:
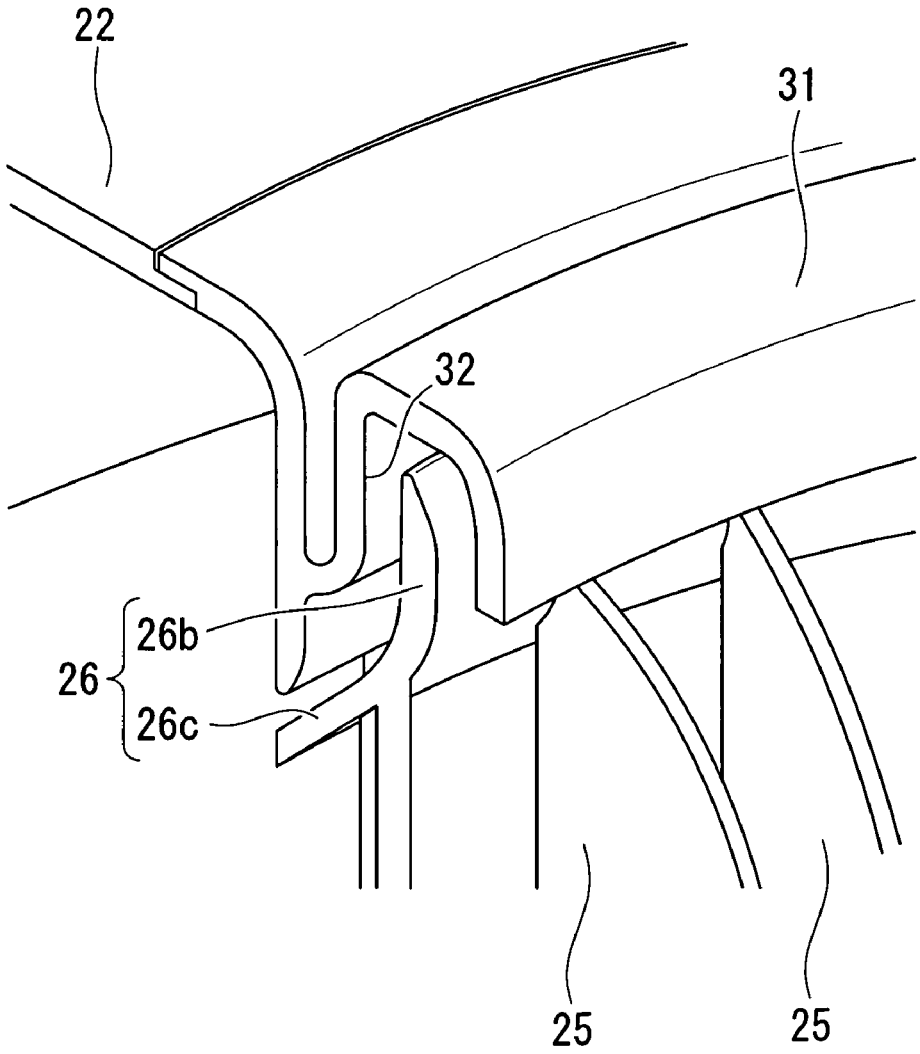
FIG. 2 is an enlarged, partial, cross-sectional perspective view showing the vicinity of a bellmouth shown in FIG. 1.

As shown in FIG. 2, the shroud 26 has a shape that is slanted with respect to the rotational axis of the driving motor 33 so as to approach the bottom plate from the inner peripheral side toward the outer peripheral side. That is, the shroud 26 includes a slanted portion 26*c* slanted so as to form a conical surface toward the outer periphery and a rising portion 26*b* rising upward from the slanted portion 26*c* along the axis of the driving motor. The rising portion 26*b* is disposed in a recess that is opened downward and that is provided at the outer peripheral side of the bellmouth 31.

Figure 3A:
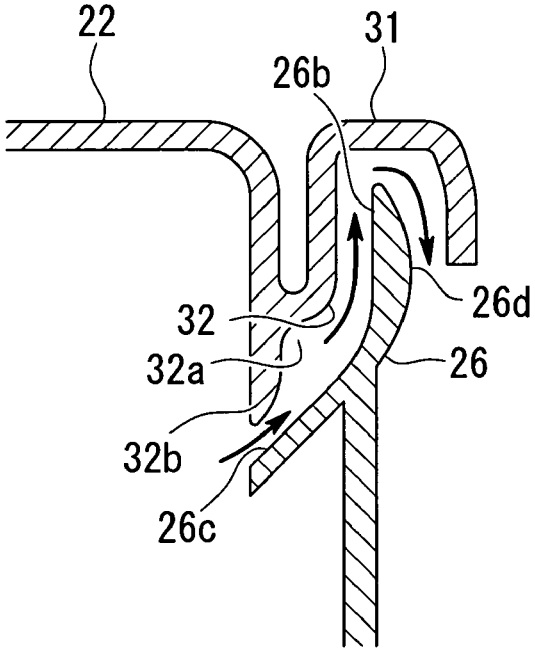
FIG. 3A is an enlarged cross-sectional view showing the positional relationship between the bellmouth and a shroud shown in FIG. 2.

As shown in FIG. 3A, the schematic cross-sectional shape of the shroud 26 is substantially a circular arc shape along a main air flow flowing from the lower part of the shroud 26.

A small space is provided between the shroud 26 and a shroud-facing wall 32 disposed at the side of the casing 22, the space extending from the upper end of the rising portion 26*b* to the outer peripheral end of the slanted portion 26*c* (the lower left in the figure) of the shroud 26. The dimension of this space is substantially uniform except for a recess 32*a* from the lower end area of the slanted portion 26*c* to the upper end area of the rising portion 26*b* of the shroud 26.

The recess 32*a* is continuously provided at the inner peripheral side of the shroud-facing wall 32 in the circumferential direction. At the recess 32*a*, the distance between the shroud-facing wall 32 and the outer peripheral surface of the shroud 26 is larger than the distance at the other part of the shroud-facing wall 32. The recess 32*a* is disposed at the inner peripheral side of an outer peripheral end 32*b* of the shroud-facing wall 32.

Accordingly, a small space is formed between the outer peripheral end 32*b* of the shroud-facing wall 32 and the shroud 26, and a space larger than this small space is formed between the recess 32*a* and the shroud 26.

A protrusion 26*d* protruding toward the inner peripheral side is provided on a wall at the inner peripheral side (the right side in FIG. 3A) of the rising portion 26*b*. Since this protrusion 26*d* is provided, the dimension of the space between the shroud 26 and the inner wall of the bellmouth 31 is initially increased and then gradually decreased from the upper end of the rising portion 26*b* toward the lower protrusion 26*d*.

Next, the operation and advantages of the centrifugal fan 1 having the above structure will be described.

When the impeller 20 is rotated by the driving motor 33, air is sucked from the bellmouth 31 by the operation of the main blades 25 of the impeller 20. The sucked air flows as a main flow between the shroud 26 and the bottom plate 24. The sucked air then passes through the main blades 25 and flows out to the scroll flow path 22*a* of the casing 22. The air flowing out to the scroll flow path 22*a* passes through an outlet 22*b* shown in FIG. 7 and is introduced into an HVAC main unit including an evaporator and a heater core.

As described above, the main flow flows from the bellmouth 31 to the scroll flow path 22*a* through the main blades 25. The pressure at the downstream side (the outlet of the impeller 20) is increased by the main flow. Accordingly, a pressure difference is generated between the shroud 26 and the shroud-facing wall 32, and as shown by the arrows in FIG. 3A, a leakage flow flowing backward from the outer peripheral side to the inner peripheral side is generated.

The flow path of this leakage flow is abruptly contracted by the outer peripheral end 32*b* of the shroud-facing wall 32 when the leakage flow flows into the space. The leakage flow thus contracted flows in the space and reaches the recess 32*a*. The leakage flow is abruptly expanded in this recess 32*a*. When the leakage flow is subjected to such a abrupt contraction and a abrupt expansion, a loss occurs in the leakage flow. Accordingly, the flow rate of the leakage flow can be minimized.

Figure 3B:
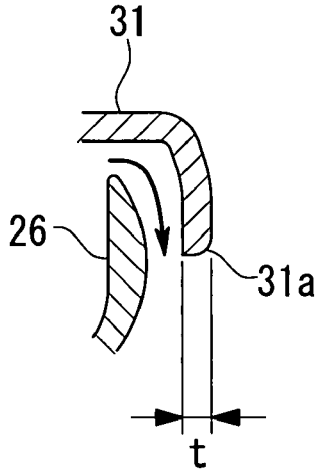
FIG. 3B is a cross-sectional view showing a modification of the shape of the inner peripheral edge at the downstream side of the bellmouth shown in FIG. 3A.

The shape of the bellmouth 31 of this embodiment may be the shape shown in FIG. 3B. More specifically, a curved surface may be provided by forming an R-shaped chamfer 31*a* on the inner peripheral edge of the downstream side of the bellmouth 31. When the thickness t at a position that does not have the R-shaped chamfer 31*a*, the position being disposed higher than the R-shaped chamfer 31*a*, is about 2 mm, the radius of curvature of the R-shaped chamfer 31*a* is preferably about 10 mm. Accordingly, the introduced air flow is not disturbed.

As in this embodiment, the R-shaped chamfer 31*a* may be provided on the inner peripheral edge at the downstream side of the bellmouth 31 together with the recess 32*a*. Alternatively, the R-shaped chamfer 31*a* may be provided independently from the structure of the recess 32*a*. The structure of this R-shaped chamfer 31*a* can also be used for the embodiments described below.

Second Embodiment

A second embodiment of the present invention will now be described with reference to FIG. 4.

This embodiment differs from the first embodiment in the shape of the inner peripheral surface of the shroud-facing wall 32. Since other structures are same as those of the first embodiment, a description thereof is omitted.

Figure 4:
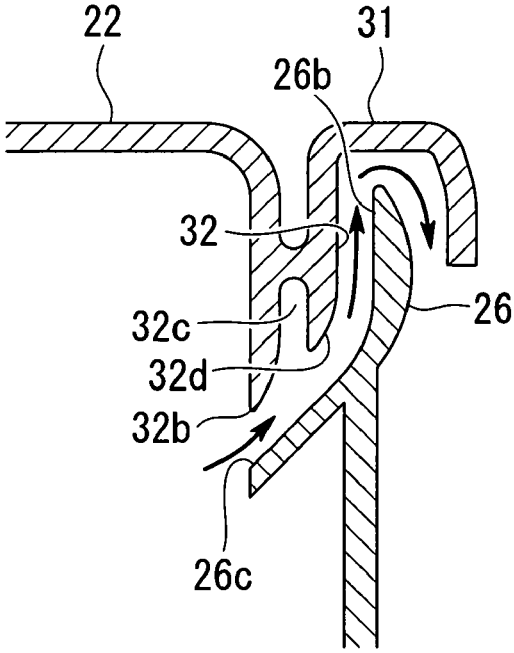
FIG. 4 is an enlarged cross-sectional view showing the positional relationship between a bellmouth and a shroud of a centrifugal fan according to a second embodiment.

As shown in FIG. 4, a first protrusion 32*d* protruding to the side of the shroud 26 is provided at the inner peripheral side (the right hand side in FIG. 4) of a recess 32*c*. Since this first protrusion 32*d* is provided, the recess 32*c* that extends in a direction parallel to the rotational axis of the driving motor 33 (the vertical direction in FIG. 4) and that has a certain width is formed. When the first protrusion 32*d* is provided as described above, a leakage flow that is abruptly expanded in the recess 32*c* can be hindered. Since a resistance can be further provided to the leakage flow in this way, not only can the flow rate of the leakage flow be reduced, but also the flow rate distribution in the circumferential direction (the rotation direction of the impeller 20) can be made uniform, thereby suppressing the generation of noise caused by flow fluctuations.

Figure 5:
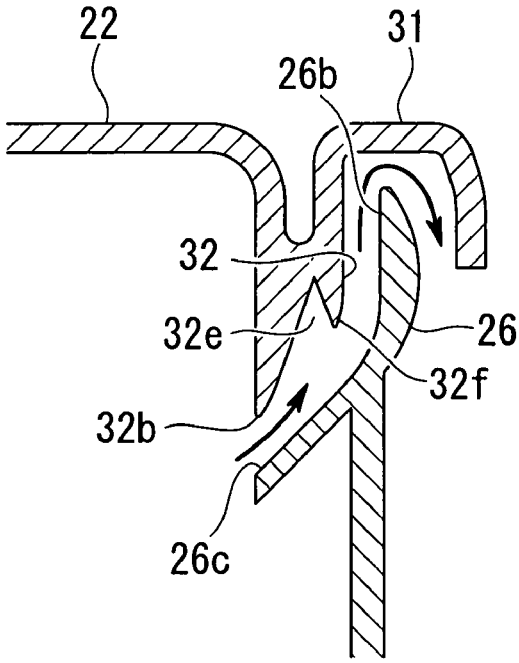
FIG. 5 is an enlarged cross-sectional view showing the positional relationship between the bellmouth and the shroud of a modification according to the second embodiment.

Alternatively, as in a modification shown in FIG. 5, a second protrusion 32*f* extending in a direction which accepts the leakage flow so as to scoop up the leakage flow may be provided. In this modification, a recess 32*e* having a substantially triangular cross section is provided. Since the second protrusion 32*f* is provided, the leakage flow can be hindered, and the flow rate distribution in the circumferential direction can be made uniform.

Third Embodiment

A third embodiment of the present invention will now be described with reference to FIGS. 6 to 8.

This embodiment differs from the first embodiment in the shape of the inner peripheral surface of the shroud-facing wall 32. Since other structures are same as those of the first embodiment, a description thereof is omitted.

Figure 6:
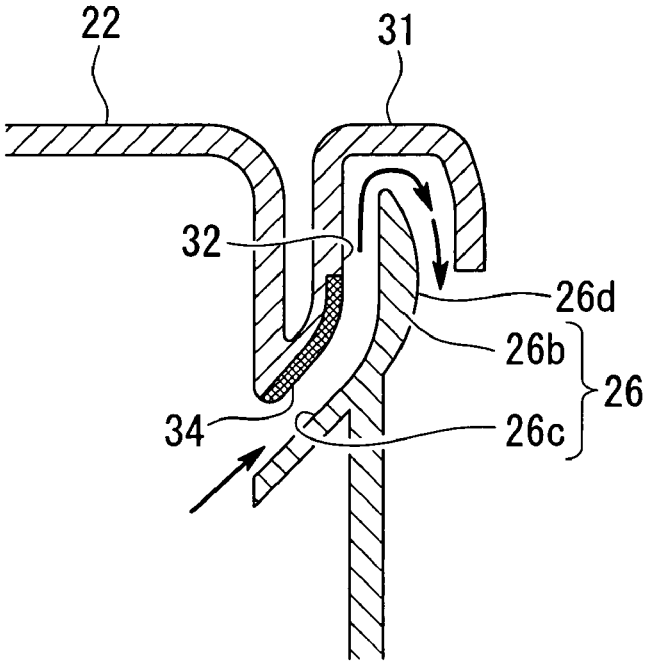
FIG. 6 is an enlarged cross-sectional view showing the positional relationship between a bellmouth and a shroud of a centrifugal fan according to a third embodiment.

As shown in FIG. 6, on the shroud-facing wall 32, a slit (groove) 34 extending substantially in the radial direction is provided from the outer peripheral end to the inner peripheral side of the shroud-facing wall 32. This slit 34 is formed by removing a part of the shroud-facing wall 32 ranging from the inner surface to a predetermined depth position. Regarding the length of the slit 34 in the radial direction, the slit 34 may be provided over the entire shroud-facing wall 32, or as shown in FIG. 6, the slit 34 may be provided only at an area corresponding to the slanted portion 26*c* of the shroud 26.

A plurality of slits 34 may be provided at predetermined intervals around the entire circumference of the shroud-facing wall 32. Alternatively, as shown in FIG. 7, the slits 34 may be provided only at predetermined areas.

Figure 7:
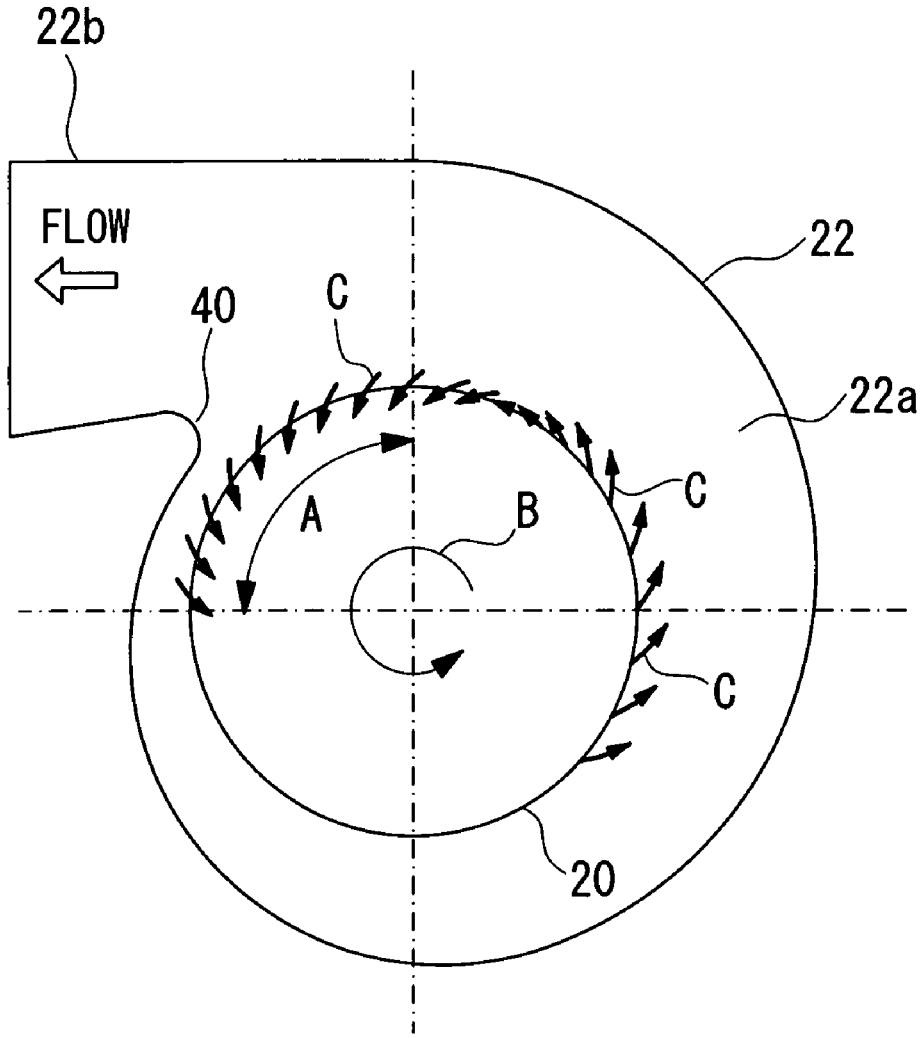
FIG. 7 is a schematic transverse sectional view of a centrifugal fan according to an embodiment of the present invention.

FIG. 7 shows a schematic transverse cross section of the centrifugal fan. The arrow B shown in FIG. 7 indicates the rotation direction of the impeller 20. A tongue 40 is provided at the upstream side of the outlet 22*b* of the scroll flow path 22*a* so as to minimize the distance between the tongue 40 and the impeller 20. The main flow discharged from the impeller 20 flows toward the scroll flow path 22*a*. In this case, as shown by the arrows C, the generation of a leakage flow due to the reverse flow tends to be significant in the vicinity of the tongue 40. Accordingly, the slits 34 may be provided on the shroud-facing wall 32 only at an area corresponding to a predetermined area A, including a range of, for example, 90 degrees, including the tongue 40.

Figure 8A:
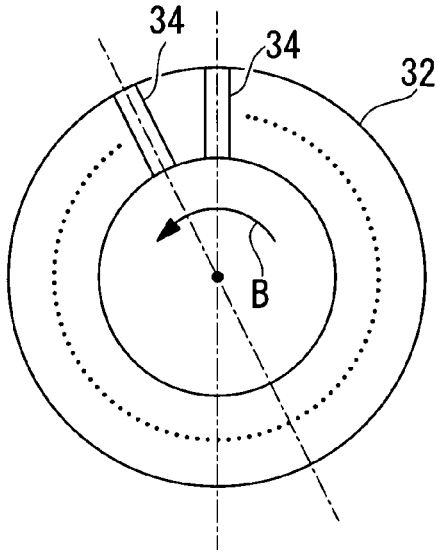
FIG. 8A is a bottom plan view of a shroud-facing wall shown in FIG. 6, showing a state in which linear slits are provided in the radial direction.
Figure 8B:
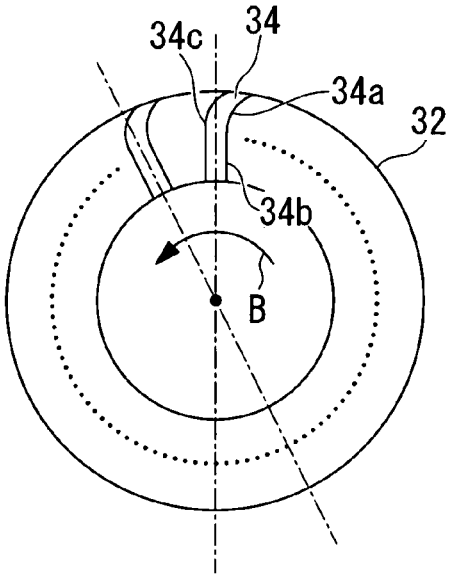
FIG. 8B shows a modification of FIG. 8A, showing slits whose outer ends, in the radial direction, are bent.
Figure 8C:
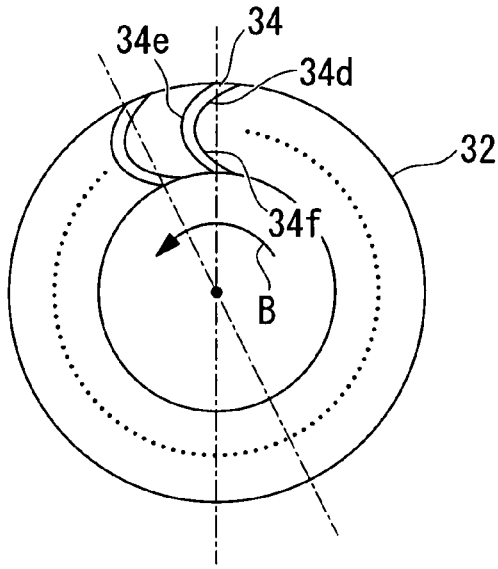
FIG. 8C shows a modification of FIG. 8A, showing slits that are bent so as to have an inflection portion.

FIGS. 8A to 8C are bottom plan views of the shroud-facing wall 32 viewed from the shroud side. In the figures, the arrow B indicates the rotational direction of the impeller 20.

The slits 34 shown in FIG. 8A are linear slits provided in the radial direction. The operation and advantages obtained by the slits 34 are as follows.

By forming the slits 34 extending in the radial direction on the shroud-facing wall 32, when viewed from the shroud 26, a space provided between the shroud 26 and the shroud-facing wall 32 continuously changes. Accordingly, a resistance can be provided to the leakage flow, thereby blocking the leakage flow.

Slits 34 shown in FIG. 8B each include an outer peripheral portion 34*a* bending so as to be slanted in a direction opposite to the rotational direction B of the impeller 20 and a linear portion 34*b* that is connected to the outer peripheral portion 34*a* and that extends in the radial direction. According to this structure, an inflection portion 34*c* in which the flow path is inflected is provided at a portion connecting the outer peripheral portion 34*a* to the linear portion 34*b*. The operation and advantages obtained by this structure are as follows.

As shown by the arrows C in FIG. 7, the leakage flow flows in the space while having a velocity component in the rotational direction of the impeller 20. Consequently, the leakage flow is taken by the outer peripheral portion 34*a* slanted in the direction opposite to the rotational direction of the impeller and is then bent by the inflection portion 34*c* connected to the outer peripheral portion 34*a*, thereby raising the pressure. Accordingly, the leakage flow can be blocked.

Slits 34 shown in FIG. 8C each include an outer peripheral portion 34*d* bent so as to be slanted in a direction opposite to the rotational direction B of the impeller and an inner peripheral portion 34*f* that is connected to the outer peripheral portion 34*d* and that turns at an inflection portion 34*e* to extend to the inner peripheral side. These slits 34 are constituted by curved lines. The operation and advantages of this structure are fundamentally the same as those of the slits 34 shown in FIG. 8B. That is, the leakage flow is taken by the outer peripheral portion 34*d* slanted in the direction opposite to the rotational direction of the impeller and is then bent by the inflection portion 34*e* connected to the outer peripheral portion 34*d*, thereby raising the pressure. Accordingly, the leakage flow can be blocked.

The above embodiments have been described using a centrifugal fan used in an HVAC unit as an example, but the present invention is not limited thereto. The present invention can be widely applied to any centrifugal fan including a shroud.

What is claimed is:

1. A centrifugal fan comprising:

an impeller that is rotated around an axis;

a casing that accommodates the impeller, that includes a bellmouth forming a substantially circular gas intake whose axis is the same as the axis around which the impeller rotates, and that forms a spiral flow path at the outer peripheral side of the impeller; and a driving unit that rotates the impeller, wherein the impeller includes a bottom plate that is rotated by the driving unit around the axis, a plurality of vanes that are disposed on the outer periphery of the bottom plate, and a substantially annular shroud that is concentrically disposed so as to face the bottom plate, with the vanes disposed therebetween, and that connects an end of each of the vanes, the shroud has a shape that is slanted with respect to the axis so as to approach the bottom plate from the inner peripheral side toward the outer peripheral side, the casing includes a shroud-facing wall that forms a space in which the dimension between the shroud and the shroud-facing wall, from the outer peripheral side to the inner peripheral side of the shroud, is substantially uniform, and the shroud-facing wall includes a recess extending in the circumferential direction, the recess being disposed at the inner peripheral side of the outer peripheral end of the shroud-facing wall that forms the space having the uniform dimension so that the recess forms a space larger than the other part of the space having the uniform dimension.

2. The centrifugal fan according to claim 1, wherein a protrusion protruding toward the shroud side is provided at the inner peripheral side of the recess.

3. A centrifugal fan comprising:

an impeller that is rotated around an axis;

a casing that accommodates the impeller, that includes a bellmouth forming a substantially circular gas intake whose axis is the same as the axis around which the impeller rotates, and that forms a spiral flow path at the outer peripheral side of the impeller; and a driving unit that rotates the impeller, wherein the impeller includes a bottom plate that is rotated by the driving unit around the axis, a plurality of vanes that are disposed on the outer periphery of the bottom plate, and a substantially annular shroud that is concentrically disposed so as to face the bottom plate, with the vanes disposed therebetween, and that connects an end of each of the vanes, the shroud has a shape that is slanted with respect to the axis so as to approach the bottom plate from the inner peripheral side toward the outer peripheral side, the casing includes a shroud-facing wall that forms a space in which the dimension between the shroud and the shroud-facing wall, from the outer peripheral side to the inner peripheral side of the shroud, is substantially uniform, and the shroud-facing wall includes a groove extending in the substantially radial direction, the recess being disposed from the outer peripheral end to the inner peripheral side of the shroud-facing wall.

4. The centrifugal fan according to claim 3, wherein the groove comprises an outer peripheral portion slanted in a direction opposite to the rotation direction of the impeller and an inflection portion that is connected to the outer peripheral portion to change the direction of a flow path.

5. The centrifugal fan according to claim 1, wherein a curved surface is provided on the inner peripheral edge of the downstream side of the bellmouth.

6. The centrifugal fan according to claim 3, wherein a curved surface is provided on the inner peripheral edge of the downstream side of the bellmouth.

* * * * *